United States Patent [19]

Cowden, II

[11] Patent Number: 4,973,946

[45] Date of Patent: Nov. 27, 1990

[54] UNDERGROUND LIQUID STORAGE TANK LEAK CONTAINMENT, DETECTION AND ALARM SYSTEM

[76] Inventor: Roger H. Cowden, II, 9985 Ainsworth Ct., Miamisburg, Ohio 45342

[21] Appl. No.: 511,551

[22] Filed: Apr. 20, 1990

Related U.S. Application Data

[63] Continuation-in-part of Ser. No. 320,956, Mar. 9, 1989.

[51] Int. Cl.[5] ..... G08B 21/00

[52] U.S. Cl. ..... 340/605; 73/49.2

[58] Field of Search ..... 340/605; 73/49.2 T; 220/445, 1 B, 5 A

[56] References Cited

U.S. PATENT DOCUMENTS

| | | | |
|---|---|---|---|
| 3,848,765 | 11/1974 | Dürkop | 73/49.2 T |
| 4,537,328 | 8/1985 | Keesee et al. | 73/49.2 T |
| 4,638,920 | 1/1987 | Goodhues, Jr. | 73/49.2 T |
| 4,672,366 | 6/1987 | Butts | 340/605 |
| 4,796,676 | 1/1989 | Hendershot et al. | 340/605 |
| 4,825,687 | 5/1989 | Sharp | 73/49.2 T |

*Primary Examiner*—Joseph A. Orsino
*Assistant Examiner*—Jill Jackson
*Attorney, Agent, or Firm*—Joseph Patrick Burke

[57] ABSTRACT

An enviromentally sound, non-contaminating underground liquid large storage tank leak containment, detection and alarm system containing: an impervious, steel reinforced, parallelpiped, non-fibrous concrete tank-containment vault. The vault has a fill pipe, a dispenser pipe, a vent pipe, and a vertical leak detection and pumpout pipe. Readily removable leak detection means are located near the vault floor within the leak detection and pumpout pipe. An electrical alarm is triggered by the leak detection means. The term "parallelpiped" describes the three dimensional vault configuration where the rectangular end walls and side walls, and the lid and floor portions are substantially parallel and each of the interior angles is approximately ninety degrees.

6 Claims, 1 Drawing Sheet

UNDERGROUND LIQUID STORAGE TANK LEAK CONTAINMENT, DETECTION AND ALARM SYSTEM

This application is a continuation-in part of U.S. patent application Ser. No. 07/320,956 filed on Mar. 9, 1989 by the present inventor.

BRIEF DESCRIPTION OF THE INVENTION

The present invention is directed to an environmentally sound, non-contaminating underground liquid large storage tank leak containment, detection and alarm system containing an impervious, steel reinforced, substantially parallelpiped, non-fibrous concrete tank-containment vault having a removable lid portion, integral side wall portions, end wall portions and a floor portion; a plurality of concrete cradle portions extending from the vault floor portion; a fill pipe and fill pipe opening; a liquid dispenser pipe and liquid dispenser pipe opening; a vent pipe and vent pipe opening; a substantially vertical leak detection and pumpout pipe providing visual leak inspection and leak detection and pumpout pipe opening; said fill pipe opening, liquid dispenser pipe opening, vent pipe opening and leak detection and pumpout pipe opening being located in the vault lid portion; readily removable leak detection means located in the vicinity of the interior vault floor portion within the leak detection and pumpout pipe and adjacent to one end wall portion and outside of the liquid storage tank; an electrical alarm trigger mechanism, triggered by the readily removable leak detection means signalling the presence of liquid on the interior vault floor; an electrical supply line connected at one end to the electrical alarm trigger mechanism and at its other end to an electrical alarm; sealant means to seal the vault lid portion to the upper periphery of the vault side and end wall portions; and sealant means to seal each of said pipe openings to each of their respective pipe exteriors. The term "substantially parallelpiped" is used to describe the three dimensional vault configuration having six sides with the rectangular end walls, side walls, lid and floor portions being substantially parallel and defining eight interior angles of approximately ninety degrees.

BACKGROUND OF THE INVENTION AND PRIOR ART

There have been many problems associated with the underground storage of gasoline, diesel fuel and other liquid materials. In the past efforts have failed in the area of making the storage tanks or secondary containment systems of non-contaminating material which would prevent leakage of the contained gasoline, diesel fuel, toxic and other liquid materials, etc., into the surrounding soil and aquifer, viz., the water-bearing strata of the earth. Characteristically such large liquid storage tanks contain from six thousand to twelve thousand gallons of liquid.

Actually, two main problems were encountered by the characteristic steel or fiberglass liquid storage tanks designed for use underground, viz., one being the outward leakage of the gas or diesel fuel from the underground storage tank, thereby contaminating the earth and possibly also the aquifer, and the other problem being the deterioration of the storage tank material, itself, over an extended period of time by exposure to any water or corrosive materials which may be present in the soil surrounding said liquid storage tank.

Recently there have been environmental protection regulations enacted which require a secondary containment system for all hazardous chemical storage tanks and the like. Moreover, some state and local regulations require, or may be expected to be changed to require, secondary containment for petroleum product storage within the reasonably immediate future. In these cases the major objective is to protect the supply of ground water from any leakage from within the liquid petroleum product and fuel storage tanks.

Another major problem caused by leakage from within the underground storage tanks of fuel and corrosive liquid chemicals is that a considerable amount of environmental contamination and damage can be done to the soil, and sometimes the underground water supply bearing strata, as well, when undetected slow leaks occur. On the other hand, sudden large leaks can produce damage as well with little or no way to ascertain that the damage has occurred until a substantial amount of liquid has leaked from the underground storage tank. In any event the legislative trend is to require stricter regulations and laws to prevent contamination of the environmental soil and underground water supplies.

Various attempts have been made to control the problem of liquid leakage from underground petroleum product and chemical storage tanks.

U.S. Pat. No. 4,696,186 issued to Sharp is directed to a storage tank having secondary containment means which comprises a rigid inner tank encased by a flexible outer jacket with a leak detecting material located therebetween and a leak detecting means associated with the closed space between the inner tank and the outer jacket. Located between the inner tank and the outer jacket is a gas pervious, continuous, foraminous or porous matting material which maintains a space between the inner tank and the jacket. The outer jacket 11 may be a synthetic plastic material.

U.S. Pat. No. 4,708,015 issued to Sharp is directed to a storage tank with a secondary containment means and a non-visual leak detection means. In this Sharp patent, there is a rigid inner tank encased by a flexible outer jacket to form a closed space containing detecting liquid material, e.g., water or water containing anti-freeze, therein and a non-visual leak detection means associated with the closed space. The detecting liquid shell at least partially fills the space between the rigid inner tank 10 and the flexible outer jacket 11. See FIG. 1 of Sharp. In this Sharp patent, the liquid detecting means 13 is located within the access tube 21 as is shown in FIGS. 1, 3 and 4. As will be noted, this access tube 21 is located at the upper portion of the flexible jacket and is exterior to the rigid inner tank 10.

Neither of these Sharp patents offers visual inspection of the installed system in combination with an electrical or mechanical alarm system. It is doubtful that these Sharp systems offer positive containment of a leaking tank contents and both of Sharp's systems pose an additional contamination risk in the event of rupture or damage to the flexible outer jacket during retrieval of the tank system.

U.S. Pat. No. 3,995,472 issued to Murray is directed to a system to detect leaks, monitor levels and activate alarms in which a specific material in the system dissolves or disintegrates on contact with a liquid, gas or vapor which is to be monitored. In the Murray system, hose 12 (FIG. 1) is made of a material which will react with the stored material present in the underground storage tank 10. Hose 12 is positioned outside of and beneath the bottom of the storage tank and a plastic wrap 16 surrounds the outer surface of the storage tank and the outer surface of the hose 12 as well. Thus a lower trough in effect is formed which the patentee states will require any leaked material to react with hose 12 which is then at the bottom of the trough. This reaction causes deterioration of the outer material of hose causing a pressure decrease to occur which is sensed by detectors in junction boxes 14 and 15, respectively. Murray U.S. Pat. No. 3,995,472 does not provide visual inspection as well as pressure and/or electrical alarm systems. It does not offer containment in the event of a tank and plastic wrap leak or rupture inasmuch as there is no secondary containment provided.

U.S. Pat. No. 4,644,354 issued to Kidd is directed to a system for detecting fluid pollutants which system includes probes for sensing the presence of a polar liquid, a non-polar liquid, and a dry condition signal, and for producing a polar liquid signal, a non-polar liquid signal and a dry condition signal. A reference circuit is included which includes a tunable element, such as a variable resistor, which is used to set the probe output signals to a predetermined voltage value, e.g., a 1-volt value indicating a polar liquid, a 2-volt value indicating a non-polar liquid, a 3-volt value indicating a dry state, and a 5-volt value indicating that the circuit is on and operating. The output signals are multiplexed and output on a signal output line. The patentee states that the definitive signal levels and the serial output mode permit an inexpensive single channel recorder to be used to provide a permanent and complete record of the probe status.

Although the Kidd patent is stated to be a fluid detector, it is readily observed that no provision is apparently made by the Kidd patent to prevent the leakage of the offending liquid from the storage tank 15, which can contain gasoline. Also no direct visual inspection is provided.

U.S. Pat. No. 4,561,292 issued to Pugnale, et al is directed to a double-wall underground container for storing liquids having a leak detecting means associated with it. The Pugnale et al system contains an above ground reservoir connected to a space between the inner and outer tanks of an underground double-wall storage liquid container. Leak detecting liquid fills the space between these tanks and extends to a surface level in the reservoir. Sensing means detects a drop in the level of the liquid in the reservoir and activates a signal when a leak develops in either of the inner and outer tanks. Pugnale et al's system lacks the capability of containing leaked material from its outershell and no provision is made for visual inspection.

An article entitled L.U.S.T. (Leaking Underground Storage Tanks Provide An Opportunity And A Challenge For The Construction Industry) published in the November, 1988 issue of CONSTRUCTOR calls attention to the environmental problems giving rise to the federal and state and local environmental regulations and states that secondary containment systems include double-walled tanks, pit liners and vaults. However, no further detailed information is given by this article concerning any types of vaults or walled structures.

U.S. Pat. No. 3,848,765 issued to Herman Durkop is directed to a double-walled tank having an inner tank 3 for storage of fuel oil and other liquids in combination with a cylindrical outer tank 2 made of a combination of asbestos and cement, preferably with continuously wound asbestos fibers, which have been determined to be carcinogenic and can contaminate the earth and water. The outer tank has what amounts to three lids, end lids 8 and 8′ top plate 10. The inner tank is provided with a fill pipe 6 and a control tube 7. The control tube may be connected to a pressure alarm actuator for operating a visual or audible alarm in the event that pressure rises within the space between the inner and outer tanks. Triple bend pipe 12 has connected in its line a pump 11 to remove a certain amount of air from the spaces between the two tanks, thereby maintaining it under negative pressure. Tube 13 passes through the top plate 10 and has connected to it a gauge or indicator 14 which indicates the pressure existing in the space between the two tanks. Note column 3, lines 65–68 through column 4, lines 1–4 of Durkop. Due to the presence of one or more substantially ninety degree bends, pipes 13 and 12 of Durkop do not provide for visual leak inspection. Due to the close tolerances between the dimensions of the inner and outer tanks in Durkop and the placement and bends in the Durkop piping system coupled with the structural configuration of his tanks; inspection, removal or replacement of Durkop's inner tank 3 can not be performed without cost prohibitive removal and replacement of his entire system.

U.S. Pat. No. 4,602,250 issued to Edward R. Peace is directed to an above ground leak detection system for an open top, acid-containing steel plating tank 10. The leak detection system is mechanically triggered by a float value having a switch electrically connected to an electrical alarm system. Float means 26 is located in a tubular projection, 24 extending upwardly along the side of the main tank 10, which contains a small reservoir 18 located on the bottom of tank 10. This reservoir extends laterally beyond one side of tank 10 and is in fluid communication with the space between the outer steel wall of tank 10 and the liner membrane 14.

U.S. Pat. No. 4,638,920 issued to George S. Goodhues, Jr., teaches a liquid storage tank 11 supported within a closed vault 12. Inspection pipes 25 are located within the exterior vault 12. There are a plurality of these. These pipes 25, when not in use for periodic inspections, are capped with suitable threaded caps, not shown. It is quite clear, for example, from an inspection of FIG. 5 of Goodhues, Jr. that the threaded cap (not shown) must be removed in order for an individual to check for leakage by inserting a measuring rod or stick into one or more of vertical pipe(s) 25. Thus, the Goodhues, Jr. patent does not have the liquid detection and removal means incorporated within pipe 25. Furthermore, in the absence of occasional spotchecks, each involving removal of these end caps (not shown) and insertion of a rod or stick into the pipe(s) 25 as shown in FIG. 5, there is and can be no detection of the presence of any liquid leaking from the inner tank into the lower most end of the Goodhues, Jr. vault. See column 4, lines 5–10 of Goodhues, Jr. Although at column 4, lines 11–15, Goodhues, Jr. states that any detection or alarm means (such as a whistle) may be provided, the patentee fails to indicate what type of system should be used, where it is to be placed, and how it is to function in detection of a leak. Installation of the Goodhues, Jr. underground storage facility for liquids would be very costly since it would require precision in order to operate properly in as much as the inner tank 11 would have to be level in order for it to function properly in pumping gasoline in and out thereof. It is apparent that the Goodhues, Jr. structure may require costly maintenance to compensate for shifting soil such as occurs during soil settling after installation. Also the sturcture of Goodhues, Jr. would be restrictive since it would require vertical support plates 16 and 20 of different heights in order to maintain inner tank 11 level in the presence of sloping wall 13 of the Goodhues, Jr. vault. Such a structure is very vulnerable to earthquakes because it has numerous supports 16/20 of different lengths on a markedly sloping floor 14, which promotes instability. Note column 4, lines 15–28, of Goodhues, Jr., wherein it is clearly stated that it is necessary to remove several feet of earth 22 to expose a removable manhole cover 33 mounted on the top wall 13 of vault 12. Removal of the manhole cover, then, enables a service person to determine the cause of the leakage problem and make on site repairs to the Goodhues, Jr. tank 11.

U.S. Pat. No. 4,537,328 issued to Kenneth M. Keesee et al, discloses a double walled tank with an outer tank 32 having an inner primary tank 20 made of steel with a plastic coating. The outer tank is formed of sheet material composed of glass fibers and plastic resin and has a coating of glass fibers and resin applied to the exterior thereof. As shown in FIGS. 5 and 6 of Keesee et al, probe member 34 is positioned between each end wall of primary tank 20 and the adjacent end wall of outer tank 32. The lower end portion 34*b* of each probe member 34 is perforated to provide a series of holes 34*c* through which fluid is permitted to flow into such probe member for testing of the fluid level between the primary and outer tanks. Each of the probes 34 extends above the level of the uppermost portions of the storage tank 10 to enable suitable testing devices to be inserted into the probe members. Thus there is no leak detection and pumpout pipe providing for visual leak inspection employed by Keesee et al and such as would permit detection of a leak and signalling same automatically without insertion of a special suitable (unspecified) testing device into the probe members 34.

Sharp U.S. Pat. No. 4,825,687 is directed to a cylindrical storage tank having an inner tank shell of fibrous reinforcing material and resin formed within a rigid outer tank to which a gas pervious material has first been applied to the inner surface thereof. Thus a closed space filled with gas pervious Material 11 is present between rigid outer tanks 10 and fibrous reinforced resin inner tank 12. Leak detection means (not specifically shown) could be some (unspecified) kind of pressure change sensor 23 capable of detecting pressure in Alternatively sensor 23 could be some unspecified analyzer capable of detecting selected liquids in the gas pervious material 11 closed space. Instead of that, a float switch (not shown) could be installed at some unspecified place in the Sharp storage tank to automatically set off an alarm when some unspecified pre-set condition is met.

DETAILED DESCRIPTION OF THE INVENTION

Figure 1:
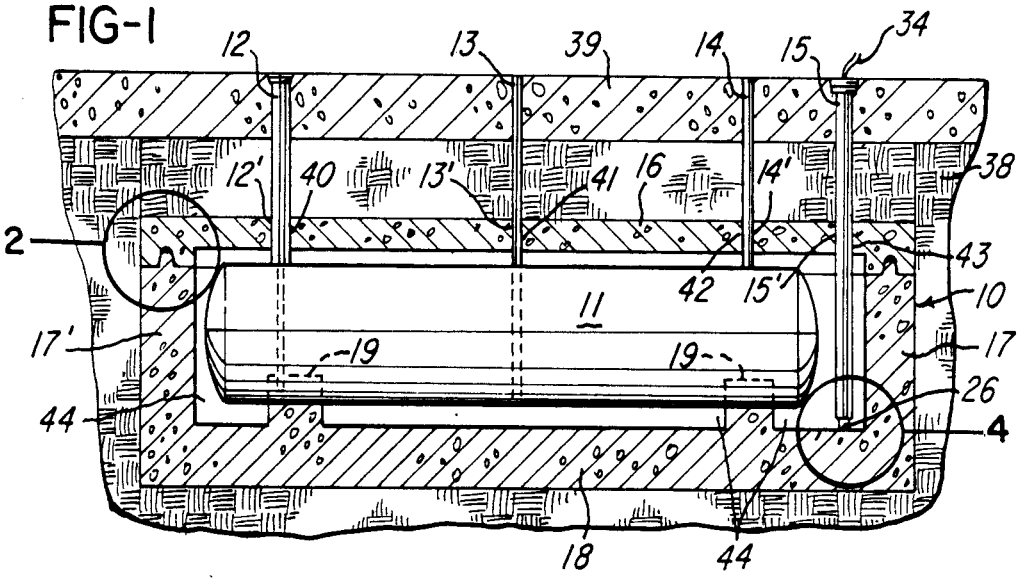
FIG. 1 is a side view, partially in section, illustrating the underground storage tank leak containment, detection and alarm system of this invention and the environment where it is used.

The unique combination of the features of the system of this invention are: a positive containment of leaked liquids from the storage tank, viz., containment of all leakage from within storage tank 11 in the open space 44 between storage tank 11 and the concrete vault system 10; the ability to test the system prior to installation and operation; a simple detection and alarm system with the capability of being tested, repaired and/or replaced without disturbing the liquid storage tank or containment system; the capability to pump the tank and containment system open space 44 without excavation or disturbance of either the storage tank or vault containment system; the capability of visual inspection down through the substantially vertical leak detection and pumpout pipe opening 45; the capability to replace a leaking storage tank by simply removing only the lid portion of the containment vault and the fill pipe, vent pipe, liquid dispenser pipe and liquid detection and pumpout pipe; and the capability to provide adequate protection in case of an earthquake. If the vault would break, the system of this invention would notify the owner of vault breakage in the event of liquid, e.g., water, gaining access to the floor 18 of the vault through the crack(s) caused by an earthquake. Also the steel-reinforced concrete containment vault would serve to absorb or dissipate some of the force of the shock energy due to the earthquake.

As is shown in FIG. 1 of the drawings, the substantially parallelpiped tank containment vault system 10 of this invention is for protection of a storage tank 11 which can be made of metal, fiberglass-resin, fiberglass filled plastic, etc. Such tanks customarily are structurally associated with a fill pipe 12, a liquid dispenser pipe 13 for dispensing liquid from the storage tank 11 and a vent pipe 14 for venting gasses from the underground storage tank 11. The tank containment concrete vault system of this invention contains a fill pipe opening 12′ in the concrete lid portion 16 of the protective vault. A dispenser pipe opening 13′ and vent pipe opening 14′ are likewise provided in the removable containment vault lid portion 16. In addition to these lid openings, an opening 15′ is provided for the vertical liquid detection and pumpout pipe 15 which is located in the vicinity of one end wall 17 of the vault 10. The vault 10 is 10 made of environmentally sound, non-contaminating, non-fibrous Portland cement concrete and contains removable lid portion 16, integral side wall portions (not shown) end wall portions 17 and 17′ and floor portion 18. Located within the interior of containment vault 10 are means 19 to support tank 11 and prevent lateral movement of this tank. These means 19 can be cradles, e.g., saddles or shims and they are preferably made of the same concrete material, and integral with, the remaining wall and floor portions of the protective vault. In accordance with this invention, removable vault lid portion 16, wall portions 17 and 17', floor portion 18 and the supporting and lateral movement preventing means 19 can all be made of, and preferably are made of, Portland cement concrete. As noted previously the entire bottom portions of vault 10 (excepting only lid 16) can be, and preferably are, one piece, viz., integral cast steel-reinforced concrete, viz., concrete reinforced with steel bars, welded steel wire mesh, etc.

Figure 2:
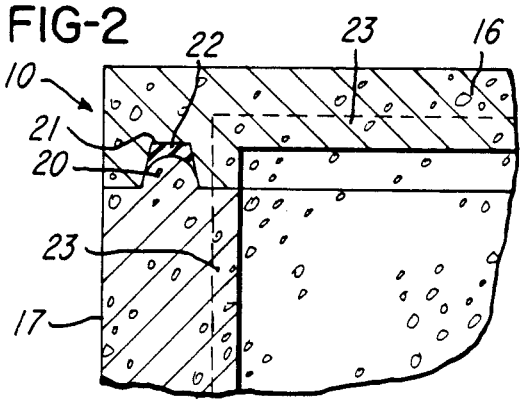
FIG. 2 is an enlarged isolated partial section of the area encircled at 2 in FIG. 1 and illustrates in detail the use of sealant to seal the vault lid to the upper periphery of the vault walls. Also an impregnated zone (23) of the interior of the vault is shown.

As will be noted from FIG. 1, and more specifically from FIG. 2, the upper portion of the upper periphery of the integral containment vault sidewalls and end walls can be substantially convex or have a substantially convex peripheral central upper lip portion 20. Correspondingly, the lower portion of containment vault lid 16 can be of an inverted substantially U-shaped concave channel 21 to create a space filled by a butyl rubber, silicone rubber(s) or elastomer(s) or other sealant 22 which seals the removable vault lid portion 16 to the upper periphery of the vault wall portions 17. This design of the configuration of the vault lid and upper peripheral central lip with sealant is of the type which is used in some burial vaults which contain coffins.

Figure 3:
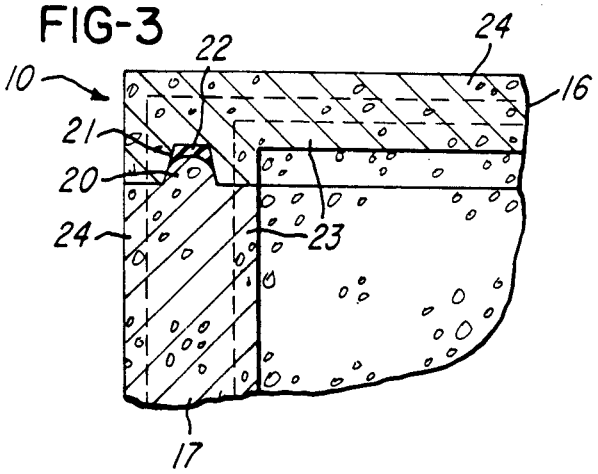
FIG. 3 is a modification of FIG. 2 illustrating an alternative embodiment ′ wherein the vault has been impregnated in both its interior zone (23) and its exterior zone (24) as well.

As is shown in FIGS. 2 and 3, the inner area zone of the vault lid, walls and floor portions as shown by dotted line at 23 can be impregnated with a material which is impervious to and hence resistant to the passage of the gasoline, diesel fuel or other liquid material contained in storage tank 11. This is so that in the event there is a leakage of such material from tank 11, that impregnated inner zone 23 will serve to stop or retard the progress of this leakage from the containment vault to the surrounding environment. Similarly, the outer area zone of the vault lid, walls and floor portions can be impregnated as shown by dotted line at 24 to provide a shielding zone of a material which is impervious to and hence resistant to inward migration or leakage of water or corrosive liquid material present in the soil or media surrounding the containment vault 10 so as to prevent or restrict inward access of such material which could otherwise contact and corrode the tank 11 located therein. Suitable impregnating materials for the inner zone, 23, include, but are not necessarily limited to: "Thompson's Water Seal", polyurethane resins and solutions thereof, petroleum distillate sealer, e.g., "Thompson's Driveway Sealer, 600-05", etc. The specific impregnant for layer 23 will depend upon the material in tank 11. Suitable impregnating materials for the outer zone 24, include, but are not limited to: "Thompson's Water Seal", asphalt emulsion type sealers of the type used to seal basement walls against water seepage, etc.

An alternative way to provide this sealant protection at (24) is by the inclusion of coal tar emulsion in the concrete mix by replacing about ten percent (10%) of the water used to make the concrete with coal tar emulsion. Then as the concrete forms, the coal tar particles fill the voids and capillaries in the developed concrete structure. Then the impregnation with sealant at 23 can be performed.

Figure 4:
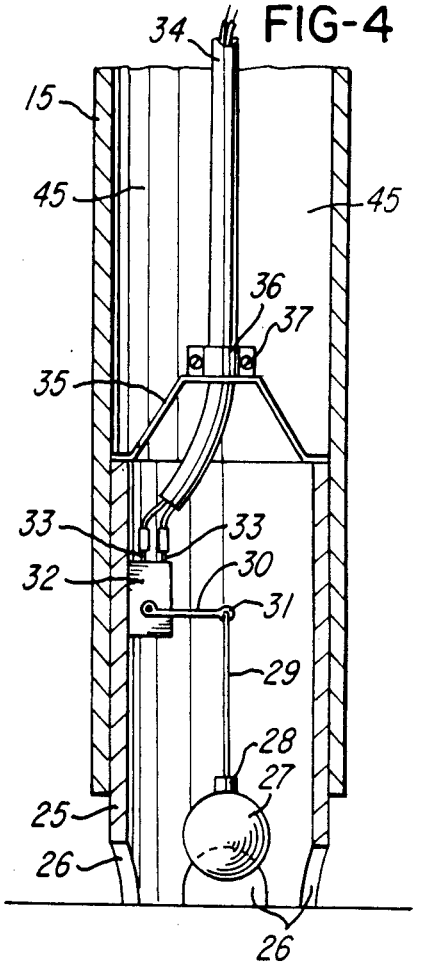
FIG. 4 is an enlarged view partly in section of the vault floor portion within the encircled area indicated at 4 in FIG. 1 partially in section illustrating the lack of detection and pumpout pipe structure (15) associated with the leak detection means, and the alarm trigger mechanism (32) connected therewith.

As will be apparent from FIGS. 1 and 4, inner float detector protective casing 25 is located in the lower portion of leak detection and pumpout pipe 15. At the bottom end of protective casing 25 are a plurality of openings 26 to permit access of any liquid either coming in from the outside through vault 10 or material leaking from tank 11 onto the vault floor 18. These openings also protect against unnoticed faulty construction and/or damage to the vault during installation of the containment vault. Located within the immediate vicinity of openings 26 is a liquid detection float ball 27 having a cap 28 connected to a riser rod 29 which is in turn connected to a riser arm 30. Riser arm 30 is connected to electrical alarm trigger mechanism 32 which operates an electrical alarm of known type (not shown) signalling the presence of liquid within the interior of the floor 18 of vault 10.

This alarm mechanism can be made to operate a sound alarm and/or produce a visual alarm and/or electronic signal. Other types of alarm signals may be produced by this electrical alarm trigger mechanism and operate an alarm which produces not only a signal at the location where a leak is occurring, but also produces a signal which can be discerned at a location somewhat remote from the vault, e.g., the office or interior of a gas station located there above, as well as at a remote monitoring location. The alarm mechanism 32 is connected by alarm lead wires 33 via an insulated electrical supply line 34 to any desired location where the alarm(s) of the desired type is(are) positioned. It is preferred to have the alarm, itself, be of the electrically operated type and to be located above ground.

The insulated electrical supply line 34 is positioned by electrical supply line collar half portions 36 supported on a support 35 positioned on the upper portion of casing 25. Appropriate securing means 37, e.g., nuts and bolts, are employed to secure the collar half portions 36 in an appropriate position surrounding the exterior of the insulated electrical supply line 34. This allows the entire leak detection assembly to be removed from pipe 15 for inspection, testing, or replacement simply by pulling electrical supply line 34 upwards without disturbing tank 11, pipe 15 or containment vault 10. Having a readily removable leak detection means (removable simply by pulling electrical supply line 35 upwards) also facilitates pumping out of leaked liquid material simply by inserting a hose down in pipe 15.

Backfill material 38 which can be earth, pea gravel, sand, etc., is placed upon and around vault 10 after sealing of the appropriate openings and surfaces thereof. As shown in FIG. 1, layer 39 of concrete, asphalt or equivalent material provides the upper surface layer, e.g., of the gas station.

Appropriate sealant means is applied at 40, 41, 42 and 43 to seal the space between the openings for the fill pipe, dispensing pipe, vent pipe and leak detection and pumpout pipe, respectively, and these respective pipes, as is shown in FIG. 1 at 40, 41, 42 and 43. Sealant means 40, 41, 42 and 43 can be of the same material as set forth previously for sealant 22; or different materials can be employed, e.g., coal tar products, asphalt, etc.

I claim:

1. An environmentally sound, non-contaminating underground liquid storage tank leak containment, detection and alarm system comprising an impervious steel reinforced, substantially parallelepiped, non-fibrous concrete tank protective vault having a removable lid portion; integral side wall portions end wall portions and a floor portion a plurality of cradle portions beneath said vault floor portion; a fill pipe and fill pipe opening; a liquid dispenser pipe and liquid dispenser pipe opening; a vent pipe and vent pipe opening; a substantially vertical leak detection and pumpout pipe and leak detection and pumpout pipe opening; said fill pipe opening, liquid dispenser pipe opening, vent pipe opening, and leak detection and pumpout pipe opening being located in the vault lid portion; readily removable leak detection means including a float ball liquid detector within a protective casing having a plurality of openings at its lower portion located in the vicinity of the interior wall portion within the leak detection and pumpout pipe and adjacent to one end wall portion outside of the liquid storage tank; an electric alarm trigger mechanism, triggered by the readily removable leak detection means, signalling the presence of liquid on the interior vault floor; an electrical supply line connected at one end to the electrical alarm trigger mechanism and at its other end to an electrical alarm; sealant means to seal the vault lid portion to the upper periphery of the vault side and end wall portions; and sealant means to seal each of said pipe openings to each of their respective pipe exteriors.

2. An underground liquid storage tank leak containment, detection and alarm system as in claim 1 wherein said concrete vault has an inner area zone containing a sealant impervious to the liquid in said storage tank and an inner open space between said storage tank and the interior of said vault to contain liquid in the event of storage tank leakage.

3. An underground liquid storage tank leak containment, detection and alarm system as in claim 1 wherein said concrete vault has an outer area zone containing a sealant impervious to liquid present in the earth and/or water media in which the vault is located.

4. An underground liquid storage tank leak containment, detection and alarm system as in claim 1 wherein the interior vault floor in the vicinity of one of said vault end wall portions can be visually inspected via said leak detection and pumpout pipe upon removal of said readily removable leak detection means.

5. An underground liquid storage tank leak containment, detection and alarm system as in claim 1 wherein said float ball has a cap connected to a riser rod connected to an arm which is, in turn, connected to said electrical alarm trigger mechanism.

6. An underground liquid storage tank leak containment, detection and alarm system as in claim 1 wherein said concrete is Portland cement concrete.

* * * * *